US010570675B2

(12) United States Patent
Robichaux et al.

(10) Patent No.: US 10,570,675 B2
(45) Date of Patent: Feb. 25, 2020

(54) METHOD AND APPARATUS FOR WELLBORE CENTRALIZATION

(71) Applicant: Blackhawk Specialty Tools, LLC, Houston, TX (US)

(72) Inventors: Ron D. Robichaux, Houston, TX (US); John E. Hebert, Houma, LA (US); Scottie J. Scott, Houma, LA (US)

(73) Assignee: Blackhawk Specialty Tools, LLC, Houston, TX (US)

( * ) Notice: Subject to any disclaimer, the term of this patent is extended or adjusted under 35 U.S.C. 154(b) by 99 days.

(21) Appl. No.: 15/399,836

(22) Filed: Jan. 6, 2017

(65) Prior Publication Data

US 2017/0198533 A1 Jul. 13, 2017

Related U.S. Application Data

(60) Provisional application No. 62/276,346, filed on Jan. 8, 2016.

(51) Int. Cl.

| | |
|---|---|
| ***E21B 17/10*** | (2006.01) |
| ***E21B 19/00*** | (2006.01) |
| ***E21B 33/14*** | (2006.01) |

(52) U.S. Cl.

CPC ..... *E21B 17/1078* (2013.01); *E21B 19/00* (2013.01); *E21B 33/14* (2013.01)

(58) Field of Classification Search

CPC ..... E21B 17/1078; E21B 19/00; E21B 17/10; E21B 17/1057; E21B 17/1028; E21B 33/14

See application file for complete search history.

(56) References Cited

U.S. PATENT DOCUMENTS

| | | | | |
|---|---|---|---|---|
| 3,055,432 | A * | 9/1962 | Park | E21B 17/1028 15/104.19 |
| 5,740,862 | A * | 4/1998 | Sable | E21B 17/1064 166/241.2 |
| 5,948,997 | A * | 9/1999 | Schmidt | G01L 3/00 29/407.02 |
| 9,057,230 | B1 * | 6/2015 | Parsons | E21B 43/103 |
| 2013/0248206 | A1 * | 9/2013 | Jordan | E21B 19/24 166/381 |
| 2015/0267512 | A1 * | 9/2015 | Parsons | E21B 43/103 166/380 |

* cited by examiner

*Primary Examiner* — David J Bagnell
*Assistant Examiner* — Manuel C Portocarrero
(74) *Attorney, Agent, or Firm* — Ted M. Anthony

(57) ABSTRACT

A centralizer assembly installed on a casing section. A bow spring assembly having bow spring members is installed around the outer surface of the casing section and can rotate about the outer surface of the casing section. A portion of the casing section that is aligned with the bow spring assembly is swaged to increase the outer diameter of that section. Bow spring heel supports prevent bow spring members from contacting the outer surface of the central casing section when compressed. Non-abrasive materials prevent damage to wellhead or other polished bore receptacles.

20 Claims, 7 Drawing Sheets

METHOD AND APPARATUS FOR WELLBORE CENTRALIZATION

CROSS REFERENCES TO RELATED APPLICATION

Priority of U.S. provisional patent application Ser. No. 62/276,346, filed Jan. 8, 2016, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to centralizers used during operations in oil and/or gas wells. More particularly, the present invention pertains to bow-type centralizers used to centralize casing strings or other tubular goods within said wellbores.

2. Brief Description of the Prior Art

Drilling of an oil or gas well is frequently accomplished using a surface drilling rig and tubular drill pipe. When installing drill pipe (or other tubular goods) into a wellbore, such pipe is typically inserted into said wellbore in a number of sections of roughly equal length commonly referred to as "joints". As a wellbore penetrates deeper into the earth, additional joints of pipe must be added to an ever lengthening "drill string" at the drilling rig in order to increase the length of said drill string.

After a wellbore is drilled to a desired depth, relatively large diameter pipe known as casing is typically installed within said wellbore and then cemented in place. When casing is installed into a wellbore, a desired length of casing is typically formed by joining together a number of individual joints or sections of roughly equal length to form a continuous string; an individual joint is threadedly connected to the upper end of the then-existing casing string at a drilling rig, the string is then lowered a desired distance into a wellbore, and the process is repeated until a casing string has a desired overall length.

As casing is installed in a wellbore, it is frequently beneficial to rotate and/or reciprocate such casing within said wellbore. After the casing is installed, cementing is performed by pumping a predetermined volume of cement slurry into the well using high-pressure pumps. The cement slurry is typically pumped down the central through bore of the casing, out the bottom or distal end of the casing, and around the outer surface of the casing.

After a predetermined volume of cement is pumped, a plug or wiper assembly is typically pumped down the inner bore of the casing using drilling mud or other fluid in order to fully displace the cement from the inner bore of the casing. In this manner, cement slurry leaves the inner bore of the casing and enters the annular space existing between the outer surface of the casing and the inner surface of the wellbore. After such cement hardens, it should beneficially secure the casing in place and form a fluid seal to prevent fluid flow along the outer surface of the casing.

In many conventional cementing operations, devices known as "centralizers" are frequently used in connection with the installation and cementing of casing in wells. Such centralizers are often "subs" that are threadedly included within a casing string in order to center such casing string within a wellbore in order to obtain a uniformly thick cement sheath around the outer surface of the casing. Different types of centralizers have been used, and casing centralization is generally well known to those having skill in the art. Centralization of a casing string near its bottom end, in particular, is frequently considered especially important to securing a uniform cement sheath and, consequently, a fluid seal around the bottom (distal) end of a casing string. For that reason, placement of centralizer subs at or near the distal end of a casing string is often desirable.

One common type of centralizer is a "bow spring" centralizer sub. Such bow spring centralizer subs typically comprise a pair of spaced-apart end bands which encircle a central tubular member that can be installed within the length of a casing string, and are held in place at a desired location on the casing. A number of outwardly bowed, resilient bow spring blade members connect the two end bands, spaced at desired locations around the circumference of said bands. The configuration of bow spring centralizers permits the bow spring blades to at least partially collapse as a casing string is run into a borehole and passes through any diameter restriction, such as a piece of equipment or wellbore section having an inner diameter smaller than the extended bow spring diameter. Such bow springs can then extend back radially outward after passage of said centralizer sub through said reduced diameter section.

Unlike conventional land or platform-based drilling operations, when drilling is conducted from drill ship rigs, semi-submersible rigs and certain jack-up rigs, subsea blowout preventer and wellhead assemblies are located on or in the vicinity of the sea floor. Typically, a large diameter pipe known as a riser is used as a conduit to connect the subsea assemblies to such rig. During drilling operations, drill pipe and other downhole equipment are lowered from a rig through such riser, as well as through the subsea blowout preventer assembly and wellhead, and into the hole which is being drilled into the earth's crust.

When a casing string is installed in such a well, the upper or proximate end of such casing string is typically seated or "landed" within a subsea wellhead assembly. In such cases, it is generally advantageous that a fluid pressure seal be formed between the casing string and the wellhead assembly. In order to facilitate such a seal, certain internal surface(s) of the subsea wellhead often include at least one polished bore receptacle or elastomer/composite sealing element which is designed to receive and form a fluid pressure seal with the casing string. As a result, the internal sealing surface of the wellhead assembly, and particularly such polished bore receptacle(s) and/or sealing elements, must be clean and relatively free from wear so that a casing string can be properly seated and sealed within the wellhead.

The running of pipe (drill string, casing and/or other equipment) through a wellhead can cause wear on the internal surface of a wellhead, thereby damaging the inner sealing profile of said wellhead and making it difficult for casing to be properly received within said wellhead. This is especially true for items having a larger outer diameter than other pipe or tubular goods passing through a wellhead (such as, for example centralizers), as such larger items have a tendency to gouge, mar, scar and/or scratch polished surfaces or sealing areas of said wellhead.

In certain circumstances, it is beneficial for components of a centralizer assembly (that is, end bands and bow springs) and said central tubular member (which is threadedly attached to the larger casing string) to be capable of rotating relative to one another. In other words, in certain circumstances (particularly when a casing string is being rotated) it is beneficial for said central tubular member to rotate within said centralizer assembly. However, when conventional centralizer bow springs are compressed—such as during passage of a centralizer assembly through restrictions in a well or other equipment—said bow springs can come in contact with and "pinch" against the outer surface of said central tubular member. Such contact generates frictional resistance forces that prevent a central tubular member from freely rotating within such centralizer components (end bands and bow springs). Conventional rotating centralizer designs cause high rotating torques due to such frictional resistance forces encountered during pipe rotation operations.

Thus, there is a need for a relatively low cost bow-spring type centralizer assembly having a low profile when in a collapsed configuration (such as when passing through a wellbore restriction), and improved rotating capability creating less frictional resistance during rotation. Said bow-spring centralizer assembly should exhibit superior strength characteristics, while minimizing damage to wellheads, polished bores or other downhole equipment.

SUMMARY OF THE INVENTION

Unlike conventional bow spring centralizers that generally comprise a bow spring assembly disposed around a tubular body or sub that can be included within an elongate casing string, the centralizer assembly of the present invention comprises a bow spring assembly disposed directly around the outer surface of a casing joint or section. Each such bow spring assembly comprises a first circular end band and a second circular end band oriented in substantially parallel relationship. A plurality of flexible bow springs extends between said first and second end bands. In a preferred embodiment, a notched design of said end bands provide for stronger bond with flush profile, with chamfers on end band notches for flush profile welding.

Said bow spring assembly is disposed around the outer surface of a section of casing to be installed in a wellbore; typically, said bow spring assembly can be slid or otherwise installed over one end of said casing section and positioned at a desired location along the length of said casing section. Said bow spring members extend radially outward from said casing section and bias said upper and lower end bands toward each other. When compressed inward, said bow spring members collapse toward said casing section, and force said upper and lower end bands away from each other. Further, at least two bushing rings are disposed around the outer surface of the casing section and positioned under the bow springs.

A casing swage ram having a desired head is inserted into the casing and positioned relative to said bow spring assembly. The swage is engaged and drawn (typically using hydraulic fluid) to create a desired upset—that is, an area of increased outer diameter—in the casing between said two bushing rings and under said plurality of bow springs. The bushing rings, one positioned on either side of the swage section, provide a square edge to interact with the bands of the bow spring assembly so that said bow spring assembly can rotate while either bow spring end band is forced toward the swaged portion of the casing section. Lead in bevels can optionally be placed on the end bands; additionally, a swaged area can also be installed above and below the centralizer end bands to serve as a guide-through for any wellbore restriction that may be encountered.

Said bow spring assembly and said central casing section are beneficially rotatable relative to one another. In one preferred embodiment, the present invention includes a bow spring heel support journal to prevent said bow spring members from contacting the outer surface of said casing section when said bow springs are compressed, such as in a wellbore restriction, even when said central casing section is rotated within said bow spring assembly.

Said bow spring heel support effectively eliminates contact between inwardly-compressed bow spring members and the outer surface of said casing section (particularly near the heels of the bow springs), as well as any torque forces and/or frictional resistance that said centralizer bow springs may create as the central casing section rotates relative to said bow spring members and end bands. Put another way, when said bow spring members are fully elongated (such as when collapsed inward), said heel supports prevent said bow spring members from contacting the outer surface of said central casing section.

Further, rotational interference can be further reduced by employing friction reducing means to assist or improve rotation of said central casing section relative to said bow spring centralizer assembly. By way of illustration, but not limitation, such friction reducing means can include bearings (including, but not necessarily limited to, fluid bearings, roller bearings, ball bearings or needle bearings). Said bearings can be mounted on the outer surface of said central casing section, the inner surface of said centralizer end bands, or both.

Additionally, the areas where said centralizer end bands contact said central casing section can be constructed of, or coated with, friction reducing material including, without limitation, silicone or material(s) having high lubricity or wear resistance characteristics. Optional lubrication ports can be provided through said end bands to inject grease or other lubricant(s) to lubricate contact surfaces between said central casing section and said centralizer end bands.

In order to reduce and/or prevent damage to wellheads and, more particularly, polished surfaces of such wellheads, components of the present material can be comprised of synthetic or composite materials (that is, non-abrasive and/or low friction materials) that will not damage, gouge or mar polished surfaces of wellheads or other equipment. In most cases, such components include bow spring members, because such bow spring members extend radially outward the greatest distance (that is, exhibit the greatest outer diameter) relative to the central body of the centralizer, and would likely have the most contact with such polished surfaces.

Certain components of the present invention (including, without limitation, central casing section, end bands or bow spring elements) can be substantially or wholly comprised of synthetic, composite or other non-metallic material. Alternatively, certain components can be constructed with a metallic center for strength, with the edges or outer surfaces constructed of or coated with a plastic, composite, synthetic and/or other non-abrasive or low friction material having desired characteristics to prevent marring or scarring of a wellhead or other polished surfaces contacted by the centralizer of the present invention. By way of illustration, but not limitation, such non-abrasive or low friction material(s) can comprise elastomeric polyurethane, polytetrafluoroethylene (marketed under the Teflon® mark) and/or other materials exhibiting desired characteristics.

In the preferred embodiment, said non-abrasive or low friction material(s) can be sprayed or otherwise applied onto desired surface(s) of the centralizer or components thereof, in much the same way that truck bed liner materials (such as, for example, truck bed liners marketed under the trademark "Rhino Liners" ®) are applied. Further, in circumstances when a centralizer of the present invention is removed from a well, such non-abrasive or low friction material can be applied (or re-applied) to such centralizer or portions thereof prior to running said centralizer back into the well.

The cost of the centralizer of the present invention is substantially less than the cost of conventional centralizers including, without limitation, bow spring centralizer subs. Because the centralizer of the present invention is operationally attached directly on existing casing that is installed in a well, there is no need for a separate central tubular body member such as with conventional bow spring centralizer subs. Moreover, because a separate central tubular body member is not utilized, no additional threads are required to be cut (on said tubular body), and there is no need for specialized make-up, bucking or pressure integrity testing services related to the connection of said tubular body member to surrounding casing sections. Rather, a bow spring assembly is installed directly on a casing section, and that casing section is installed or included directly as part of a casing string in a wellbore.

Notwithstanding the foregoing (including, without limitation, the references to bow spring centralizers set forth herein), it is to be observed that rigid centralizers or other centralizer assemblies can also be utilized in place of said bow spring centralizers. Additionally, many different objects or assemblies other than centralizers (bow spring or otherwise) can be operationally attached to the outer surface of a section of casing or pipe, and secured against axial movement along the length of said casing or pipe (or, when movement along a portion of said length is desired, within defined end points), using a central swaged or upset area that expands the outer diameter of said section of casing or pipe; by way of illustration, but not limitation, said objects or assemblies can include stabilizers, sensors or other down hole equipment. Further, although described herein primarily in connection with "low-profile" or close tolerance bow spring centralizers, the present invention can also be used in other applications where close radial tolerance is not required or desired.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
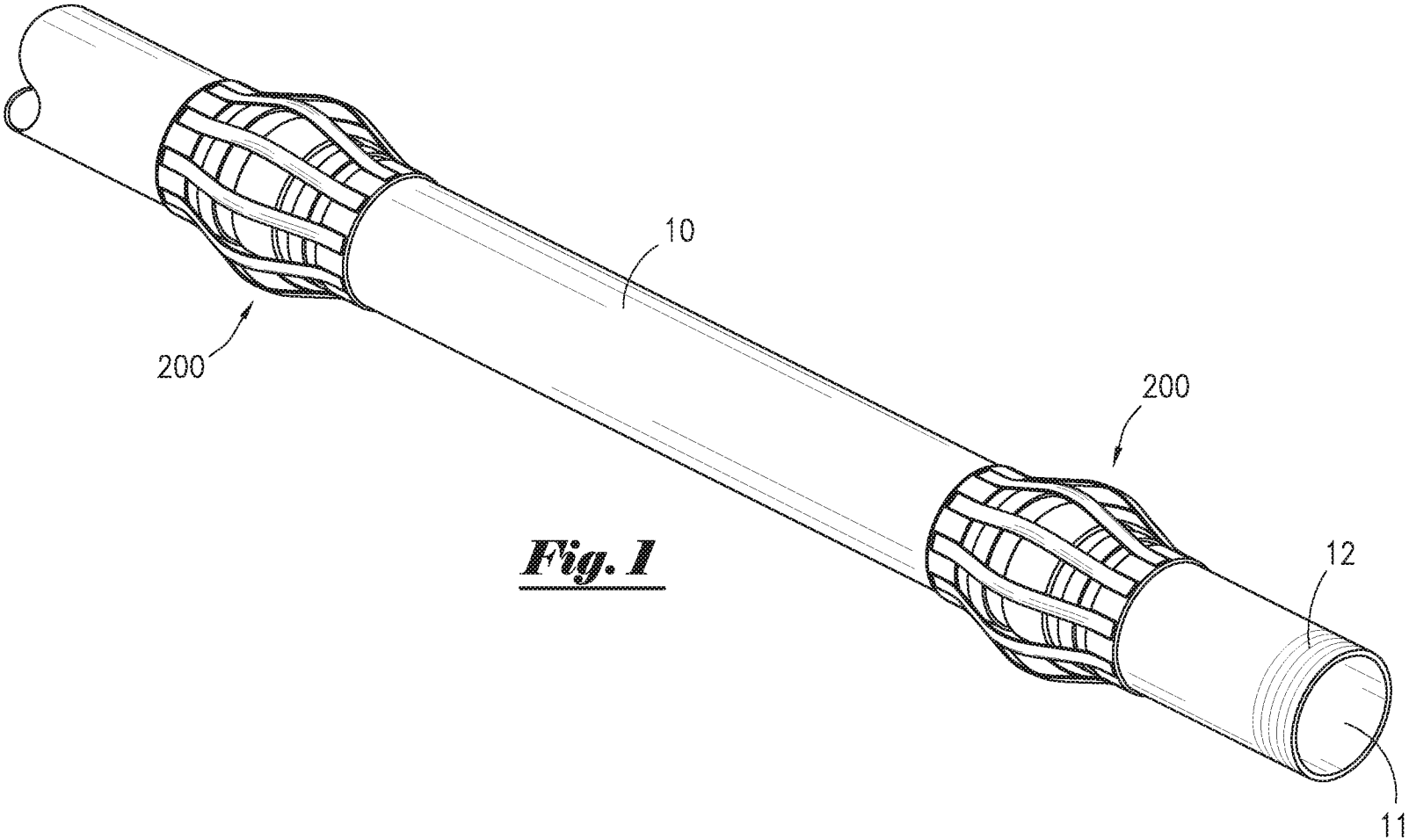
FIG. 1 depicts a perspective view of two centralizer assemblies of the present invention disposed on a section of casing.

Referring to the drawings, FIG. 1 depicts a perspective view of a plurality of centralizer assemblies 200 of the present invention. As depicted in FIG. 1, centralizer assemblies 200 can be deployed in connection with a conventional casing joint or section 10 having a central bore 11 extending therethrough. Casing section 10 has a generally tubular shape and lower threaded connection. In the preferred embodiment, said lower threaded connection comprises a male pin-end threaded connection 12; although not shown in FIG. 1, casing section 10 can also include an upper threaded connection, which typically comprises a female threaded connection or a female box-end buttress threaded connection.

As previously discussed, after a well is drilled to a desired depth, casing can be installed in said well by joining together a number of individual joints or sections of roughly equal length in end-to-end configuration to form a continuous casing string having a desired overall length. As part of this process, each individual joint is threadedly connected to the upper end of the then-existing casing string at a drilling rig, and the string is then lowered a desired distance into a well. The process is repeated until a casing string has a desired overall length. Casing section 10, including centralizer assemblies 200, can beneficially mate with threaded connections of casing or other tubular goods, thereby allowing said centralizer assemblies 200 to be selectively included within an elongate casing string at desired positions along the length of said casing string.

Figure 2:
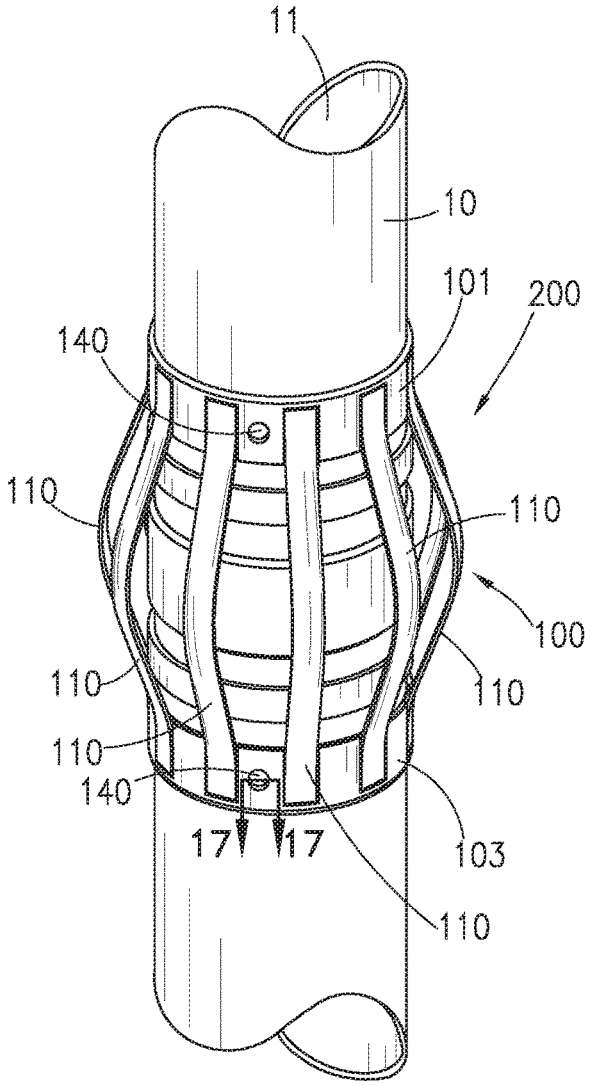
FIG. 2 depicts a perspective view of a centralizer assembly of the present invention.

FIG. 2 depicts a perspective view of a centralizer assembly 200 of the present invention installed on casing section 10. Said centralizer assembly 200 further comprises bow spring assembly 100 disposed around the outer surface of casing section 10. Bow spring assembly 100 further comprises substantially cylindrical upper end band 101 and substantially cylindrical lower end band 103. As depicted in FIG. 1, said end bands 101 and 103 extend around the outer circumference of said casing section 10 in substantially parallel orientation.

A plurality of bow spring members 110 having predetermined spacing there between extend between said upper end band 101 and said lower end band 103. In a preferred embodiment, upper end band 101 and lower end band 103 are beneficially manufactured using a machining process (for example, wherein a piece of raw material is cut into a desired final shape and size by a controlled material-removal process), whereas conventional centralizer end bands are commonly manufactured from rolled flat steel members. Said machined upper and lower end bands provide for more precise tolerances than conventional rolled steel end bands.

Figure 3:
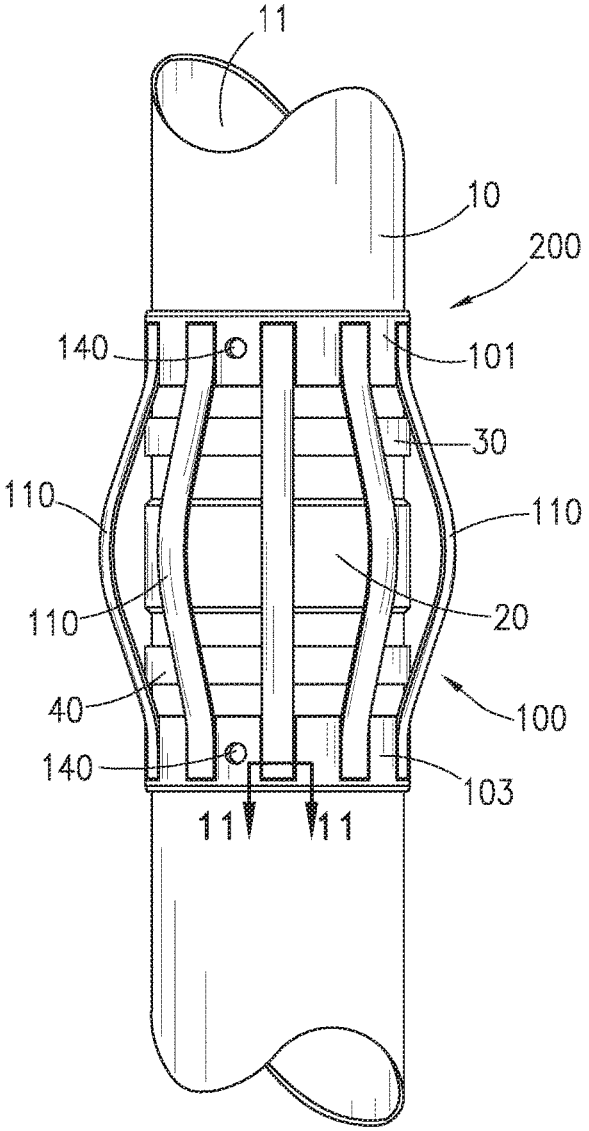
FIG. 3 depicts a side view of a centralizer assembly of the present invention.

FIG. 3 depicts a side view of said centralizer assembly 200 with bow spring assembly 100 installed on casing section 10. Bow spring members 110 extend radially outward from the outer surface of said casing section 10. As depicted in FIG. 3, bow spring members 110 extend radially outward, thereby biasing upper end band 101 and lower end band 103 generally toward each other. As depicted in FIG. 3, said bow spring members 110 extend radially outward to create a larger overall outer diameter for centralizer assembly 200, compared to the outer diameter of said casing section 10.

Still referring to FIG. 3, in a preferred embodiment, centralizer assembly 200 further comprises expanded section 20 of casing section 10; said expanded section 20 is beneficially positioned along the length of said casing section 10 between upper end band 101 and lower end band 103, and generally beneath or under bow spring members 110. Additionally, centralizer assembly 200 further comprises upper bushing 30 and lower bushing 40.

Figure 4:
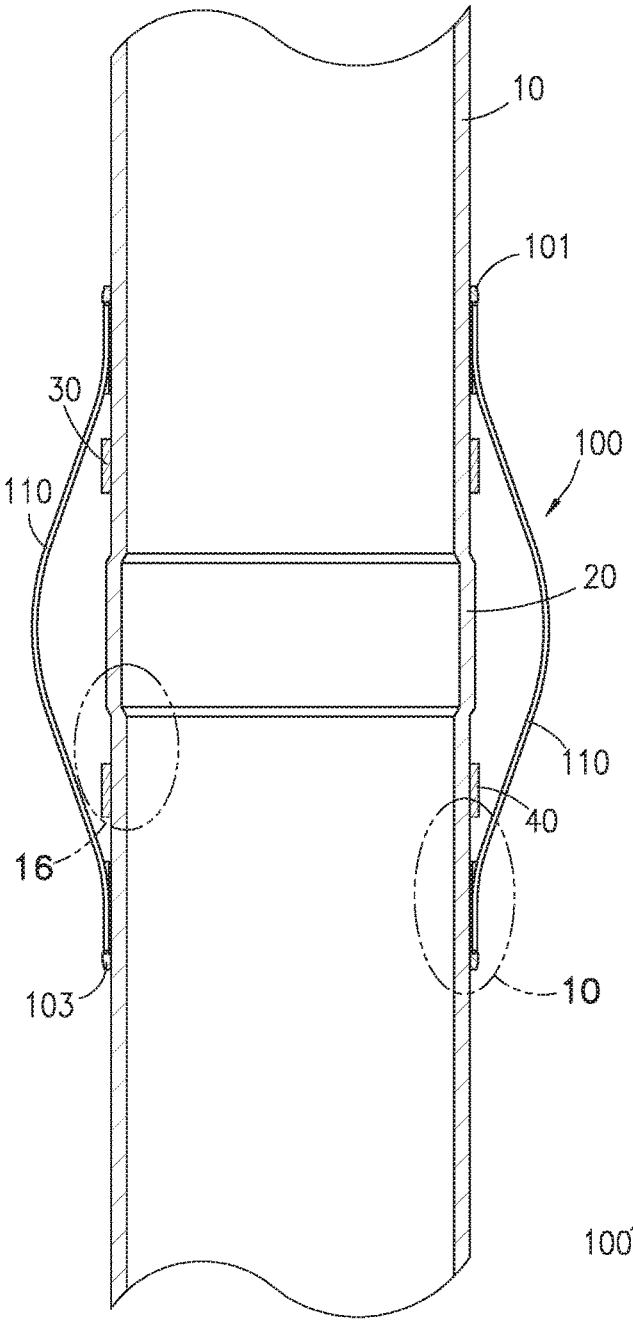
FIG. 4 depicts a side sectional view of a preferred embodiment of a centralizer assembly of the present invention.

FIG. 4 depicts a side sectional view of a preferred embodiment of bow spring assembly 100 disposed around the outer surface of casing section 10. Substantially cylindrical upper end band 101 and substantially cylindrical lower end band 103 each extend around the outer circumference of said casing section 10 in substantially parallel orientation. A plurality of bow spring members 110 extend between said upper end band 101 and said lower end band 103. Bow spring members 110 extend radially outward from the outer surface of said casing section 10, thereby biasing upper end band 101 and lower end band 103 generally toward each other.

Expanded section 20 is beneficially positioned along the length of said casing section 10 between upper end band 101 and lower end band 103. Said expanded section 20 generally comprises an "upset"—that is, an area of increased outer diameter—in casing section 10 between said two bushing rings and under said plurality of bow springs 110. In a preferred embodiment, the outer diameter of said expanded section 20 is at least as large as the larger of the inner diameters of upper end band 101 and lower end band 103. In this configuration, said end bands 101 and 103 can travel a limited distance in either axial direction, but cannot pass over the outer diameter of said expanded section 20 (thereby preventing bow spring assembly 100 from moving beyond said expanded section 20 in either axial direction).

Still referring to FIG. 4, substantially cylindrical upper bushing 30 is disposed around the outer surface of casing section 10 and is positioned generally between expanded section 20 and upper end band 101. Similarly, substantially cylindrical lower bushing 40 is disposed around the outer surface of casing section 10, and is positioned generally between expanded section 20 and lower end band 103. Although depicted as being continuous rings, it is to be observed that upper bushing 30 and lower bushing 40 can be interrupted and not continuous around the outer surface of casing section 10

Figure 5:
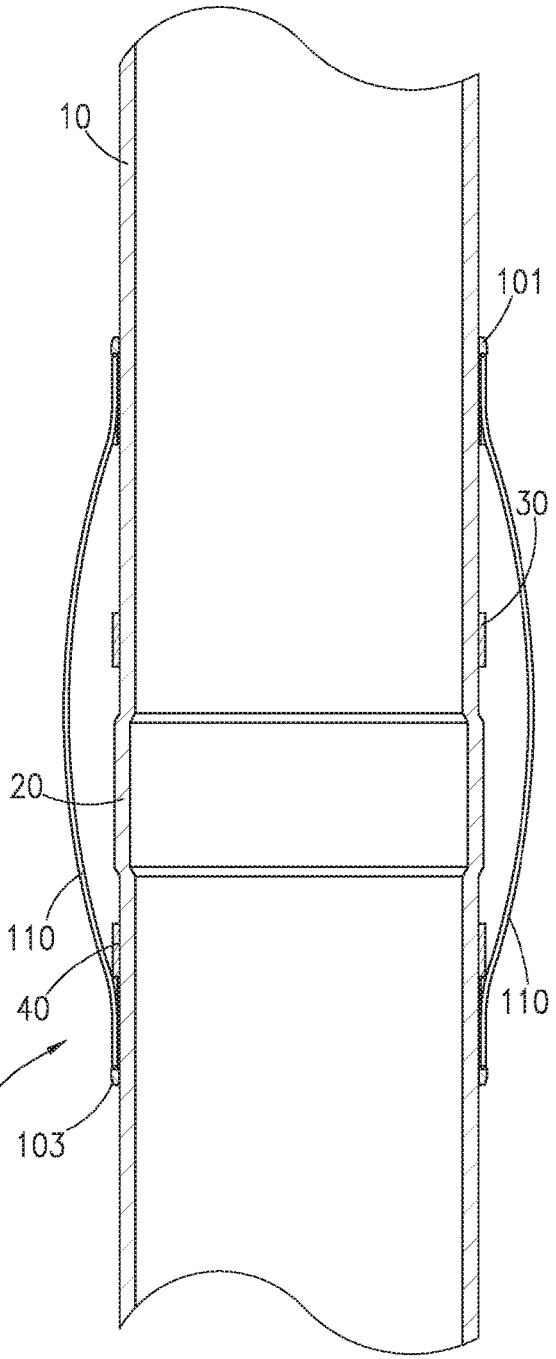
FIG. 5 depicts a side sectional view of a preferred embodiment of a centralizer assembly of the present invention.

FIG. 5 depicts a side sectional view of a preferred embodiment of bow spring assembly 100 disposed around the outer surface of casing section 10, wherein bow spring members 110 are at least partially compressed or collapsed inward compared to the depiction in FIG. 4. In the configuration depicted in FIG. 5, said inward deflection of bow spring members 110 forces upper end band 101 and lower end band 103 generally apart or away from each other. Further, as depicted in FIG. 5, lower end band 103 is forced against lower bushing 40 (such as, for example, when a centralizer assembly of the present invention is pushed through a wellbore restriction or "tight spot" during installation in a well).

Upper bushing 30 and lower bushing 40 beneficially provide square edges to interact with upper end band 101 and/or lower end band 103, respectively, so that said bow spring assembly 100 can rotate while either end band is forced toward expanded section 20 (such as, for example, when a centralizer assembly of the present invention is pushed or pulled through a wellbore restriction or "tight spot" during installation in a well). Although not depicted in FIG. 4 or 5, lead in bevels can optionally be placed on end bands 101 and 103. Further, additional expanded areas can be formed above and below centralizer end bands 101 and 103 to serve as a guide-through for any wellbore restriction that may be encountered.

Figure 6:
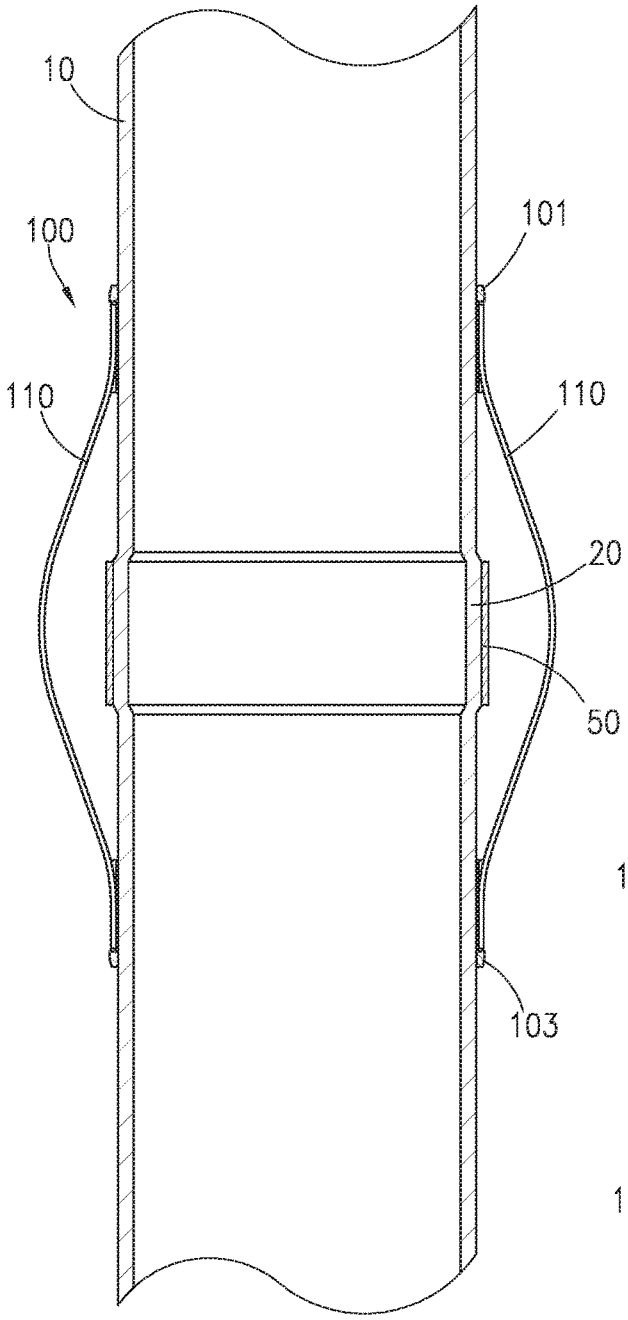
FIG. 6 depicts a side sectional view of a first alternative embodiment of a centralizer assembly of the present invention.
Figure 7:
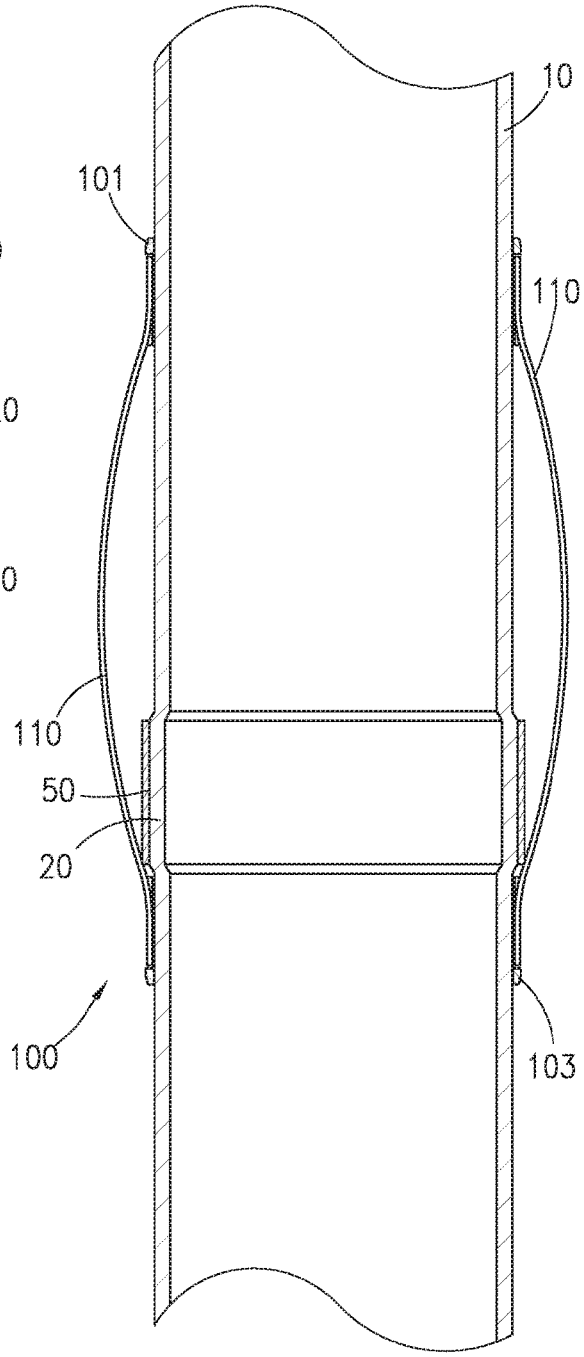
FIG. 7 depicts a side sectional view of a first alternative embodiment of a centralizer assembly depicted in FIG. 6.

FIGS. 6 and 7 depict side sectional views of a first alternative embodiment of a centralizer assembly of the present invention. Substantially cylindrical upper end band 101 and substantially cylindrical lower end band 103 each extend around the outer circumference of said casing section 10 in substantially parallel orientation. A plurality of bow spring members 110 extend between said upper end band 101 and said lower end band 103.

Expanded section 20 is beneficially positioned along the length of said casing section 10 between upper end band 101 and lower end band 103. As discussed in connection with the embodiment depicted in FIGS. 4 and 5, expanded section 20 generally comprises an "upset"—that is, an area of increased outer diameter—in casing section 10 between upper end band 101 and lower end band 103, and under said plurality of bow springs 110. In the embodiment depicted in FIGS. 6 and 7, substantially cylindrical central bushing 50 is disposed around the outer surface of casing section 10, and is positioned generally around expanded section 20 (however, upper bushing 30 and lower bushing 40 are not present).

Referring to FIG. 6, bow spring members 110 extend radially outward from the outer surface of said casing section 10, thereby biasing upper end band 101 and lower end band 103 generally toward each other. Referring to FIG. 7, inward deflection of bow spring members 110 forces upper end band 101 and lower end band 103 generally apart or away from each other. Further, as depicted in FIG. 6, lower end band 103 is forced against central bushing 50 (such as, for example, when a centralizer assembly of the present invention is pushed through a wellbore restriction or "tight spot" during installation in a well).

Instead of two bushing rings (30 and 40, depicted in FIGS. 4 and 5), a single central bushing ring is disposed on the external surface (outer diameter) of casing section 10 at least partially corresponding to expanded section 20, and without restricting or reducing the internal diameter of said casing section 10. Said central bushing 50 defines substantially squared-off edges to interact with upper end band 101 and lower end band 103. In this embodiment, less swaging is required to create a high strength stop for said end bands 101 and 103, and includes added support material on the external surface of expanded section 20.

Figure 8:
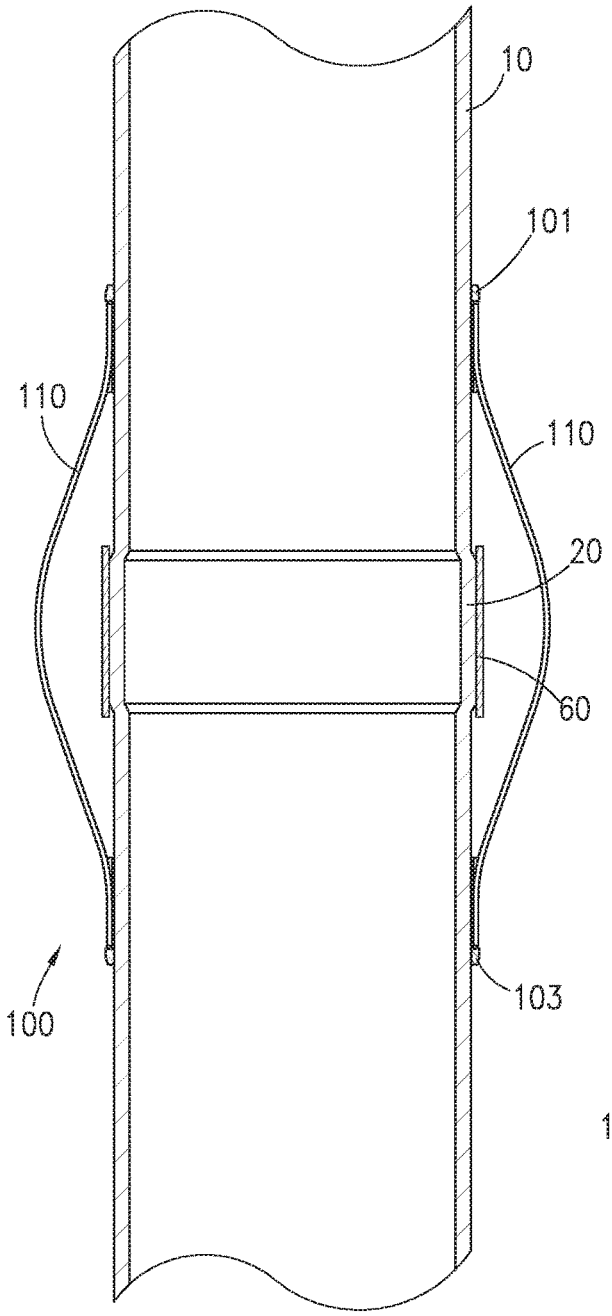
FIG. 8 depicts a side sectional view of a second alternative embodiment of a centralizer assembly of the present invention.
Figure 9:
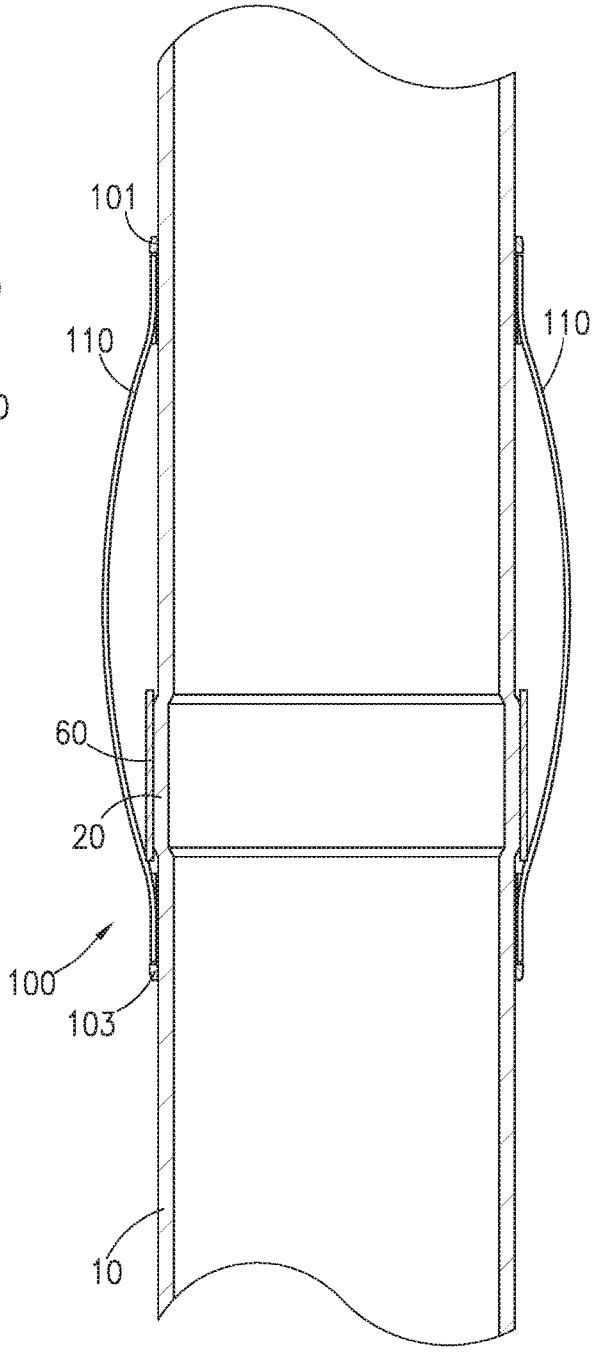
FIG. 9 depicts a side sectional view of a second alternative embodiment of a centralizer assembly depicted in FIG. 8.

FIGS. 8 and 9 depict side sectional views of a second alternative embodiment of a centralizer assembly of the present invention. Substantially cylindrical upper end band 101 and substantially cylindrical lower end band 103 each extend around the outer circumference of said casing section 10 in substantially parallel orientation, while a plurality of bow spring members 110 extend between said upper end band 101 and said lower end band 103.

Expanded section 20 is beneficially positioned along the length of said casing section 10 between upper end band 101 and lower end band 103 and forms an area of increased outer diameter in casing section 10 under said plurality of bow springs 110. In the embodiment depicted in FIGS. 8 and 9, substantially cylindrical expanded bushing 60 is disposed around the outer surface of casing section 10, and is positioned generally around expanded section 20.

Referring to FIG. 8, bow spring members 110 extend radially outward from the outer surface of said casing section 10, thereby biasing upper end band 101 and lower end band 103 generally toward each other. Referring to FIG. 9, inward deflection of bow spring members 110 forces upper end band 101 and lower end band 103 generally apart or away from each other. Further, as depicted in FIG. 9, lower end band 103 is forced against expanded bushing 60 (such as, for example, when a centralizer assembly of the present invention is pushed through a wellbore restriction or "tight spot" during installation in a well).

In all embodiments depicted in FIGS. 1 through 9, bow spring assembly 100 is beneficially rotatable relative to the outer surface of casing section 10, whether bow springs 110 are in either an expanded or collapsed configuration. In most circumstances, bow spring assembly 100 remains stationary while casing section 10 is rotated (typically, from torque forces applied by a drilling rig at the earth's surface) relative to said bow spring assembly 100.

Figure 10:
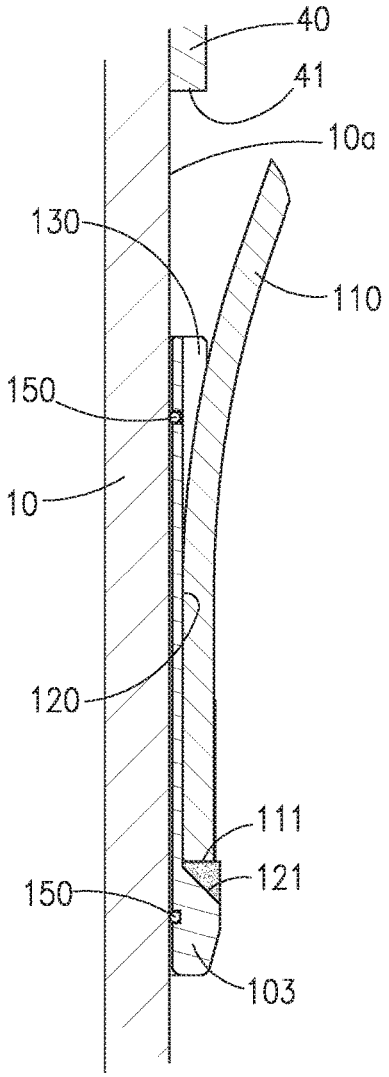
FIG. 10 depicts a side sectional view of a bow spring member and end band of a centralizer assembly of the present invention, as highlighted in area "10" of FIG. 4.

FIG. 10 depicts a side sectional view of a bow-spring member 110 and lower end band 103 of a centralizer assembly of the present invention, which is a detailed view of highlighted area "10" in FIG. 4. End 111 of bow spring member 110 is received within notched recess 120 in end band 103 and welded in place to secure said bow spring member 110 to said end band 103. Further, bow spring heel support 130 is disposed between bow spring member 110 and the outer surface 10*a* of casing section 10, and prevents such bow spring member 110 from contacting said outer surface 10*a* of said casing section 10 when said bow spring member 110 is compressed or collapsed inward, such as when said centralizer assembly passes through a restriction or "tight spot" within a well bore.

Still referring to FIG. 10, said bow spring heel support 130 effectively eliminates contact between inwardly-compressed bow spring members 110 and outer surface 10*a* of casing section 10 (particularly near the heels of said bow spring members 110), reducing any friction that would be created by said bow spring members 110 contacting said outer surface 10*a*. Reducing such friction results in reduced resistance as casing section 10 rotates within said collapsed bow spring members 110 and end bands 103 (as well as end band 101, not shown in FIG. 10). Further, said bow spring heel support 130 and end band 103 also provides a centralizer stop that, together with shoulder surface 41 of lower bushing ring 40, prevents centralizer end band 103 from sliding off casing section 10.

Still referring to FIG. 10, chamfered edge surface 121 of recess 120, which receives end 111 of bow spring member 110, permits a flush profile weld (for example, using "MIG" or "TIG" welding, or other joining method) and provides for a stronger welded bond between said bow spring member 110 and end band 103. Such flush profile weld ensures that a weld bead does not extend beyond the outer surface of end band 103. Moreover, the quality of such weld is also more easily inspected and verifiable than welds made on conventional bow spring centralizers.

In many cases, casing strings or components thereof are constructed of alloys or other premium materials. Generally, it is not desirable for such alloys or other materials to contact conventional carbon steel elements, since contacting of such dissimilar materials can cause corrosion, pitting or other undesirable conditions. Accordingly, casing section 10, as well as end bands 101 and 103, can be constructed out of like material that is consistent with the remainder of a casing string being run (such as, for example, alloys, chrome or premium materials), while bow spring members 110 can be constructed of or contain dissimilar or different materials. Bow spring heel supports 130 further ensure that bow springs 110 will not contact outer surface 10*a* of casing section 10, which may be constructed of an alloy, chrome or premium material.

By way of illustration, but not limitation, upper end band 101 and lower end band 103, as well as casing section 10, can be constructed of chrome (which is compatible with a casing string being installed), while bow spring members 110 can be constructed of spring steel. Heel support members 130 prevent dissimilar materials from contacting each other; spring steel in bow spring members 110 will not make physical contact with central tubular member 10.

Figure 11:
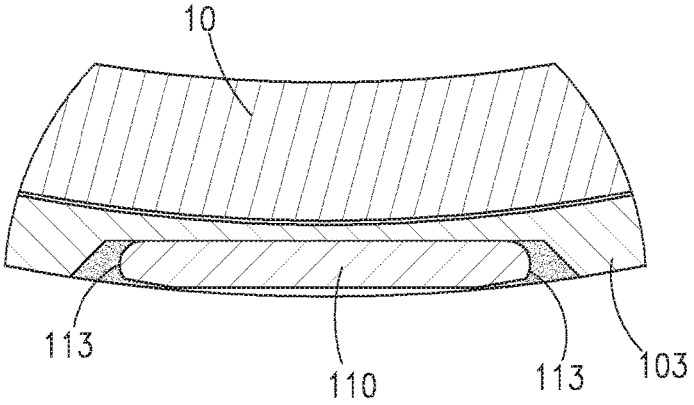
FIG. 11 depicts an end sectional view of a bow spring member and end band of a centralizer assembly of the present invention.

FIG. 11 depicts a sectional view of a bow spring member 110 having rounded or curved outer edges 113. Such rounded outer edges 113 eliminate many sharp edges that can damage, gouge or mar polished surfaces of wellheads and other equipment. Such rounded edges permit the use of bow spring members 110 having thicker cross sectional areas, thereby increasing spring forces generated by said bow spring members 110.

In order to reduce and/or prevent damage to wellheads and, more particularly, polished surfaces of such wellheads, certain components of the present material can be wholly or partially constructed of synthetic or composite materials (that is, non-abrasive, low friction and/or non-metallic materials) that will not damage, gouge or mar polished surfaces of wellheads. In most cases, such components include bow spring members 110, because such bow spring members 110 extend radially outward the greatest distance relative to central body 10 of the centralizer, and would likely have the most contact with such polished surfaces.

The flush profile depicted in FIGS. 10 and 11 is significant and highly desirable, because conventional methods of joining bow springs to an end band (such as, for example, bands and notches having abutting, squared-off edges) can result in weld beads forming on butt joints. Such weld beads can protrude radially outward from the outer surface of an end band (such as end bands 101 and 103), forming an unwanted protrusion that can damage wellheads or other equipment contacted by said centralizer assembly. Frequently, the largest outer diameter of conventional centralizer assemblies occurs where said bow springs are welded to end bands. The flush-profile welding of the present invention ensures that no weld bead extends beyond the outer diameter of said end bands.

Alternatively, certain components (including, without limitation, bow spring members 110) can be constructed with a metallic center for strength characteristics, with the edges or outer surfaces constructed of or coated with a plastic, composite, synthetic and/or other non-abrasive or low friction material having desired characteristics to prevent marring or scarring of a wellhead or other polished surfaces contacted by the centralizer of the present invention. Such non-abrasive or low friction material(s) can comprise elastomeric polyurethane, polytetrafluoroethylene (marketed under the Teflon® mark) and/or other materials exhibiting desired characteristics.

In a preferred embodiment, said non-abrasive or low friction material(s) can be beneficially sprayed or otherwise applied onto desired surface(s) of the centralizer or components thereof, similar to the way that bed liner materials (such as, for example, bed liners marketed under the trademark "Rhino Liners"®) are applied to truck beds. Further, in circumstances when a centralizer assembly of the present invention is removed from a well, such non-abrasive or low friction material can be applied (or re-applied) to such centralizer assembly or portions thereof prior to running said centralizer back into said well.

Figure 15:
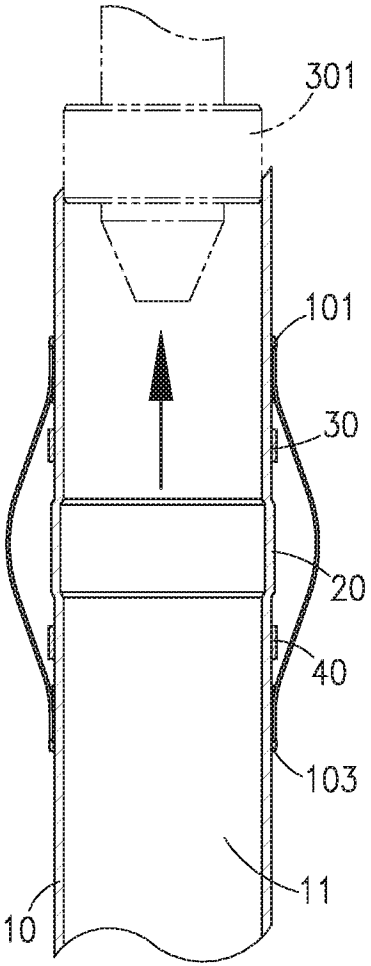
FIGS. 12 through 15 depict side sectional views of a sequential method for manufacturing a centralizer assembly of the present invention.
Figure 14:
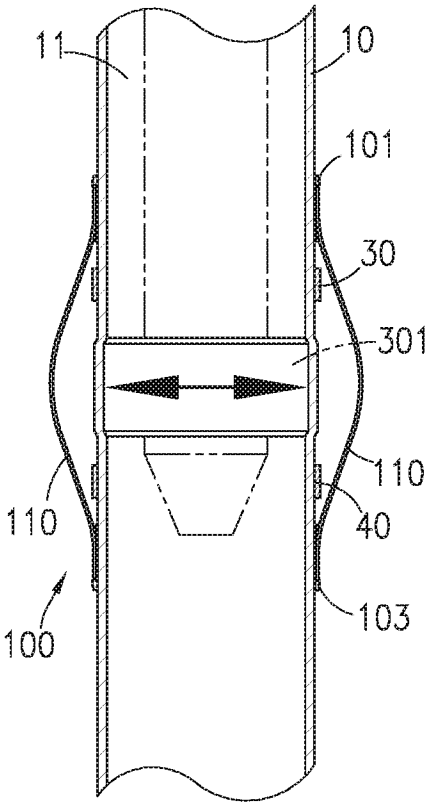
Figure 13:
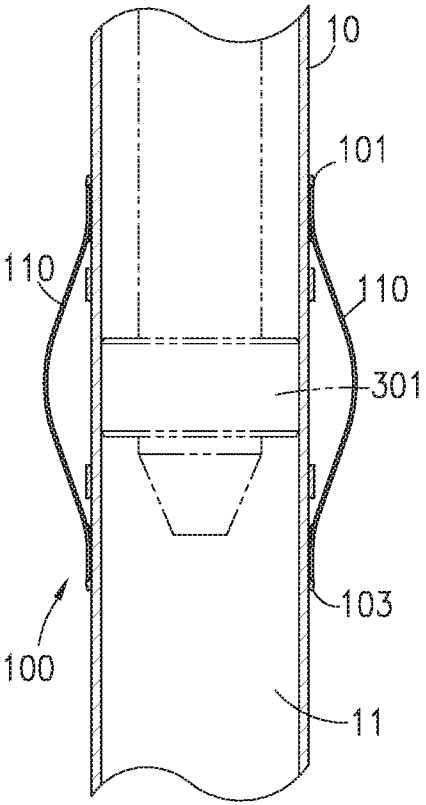
Figure 12:
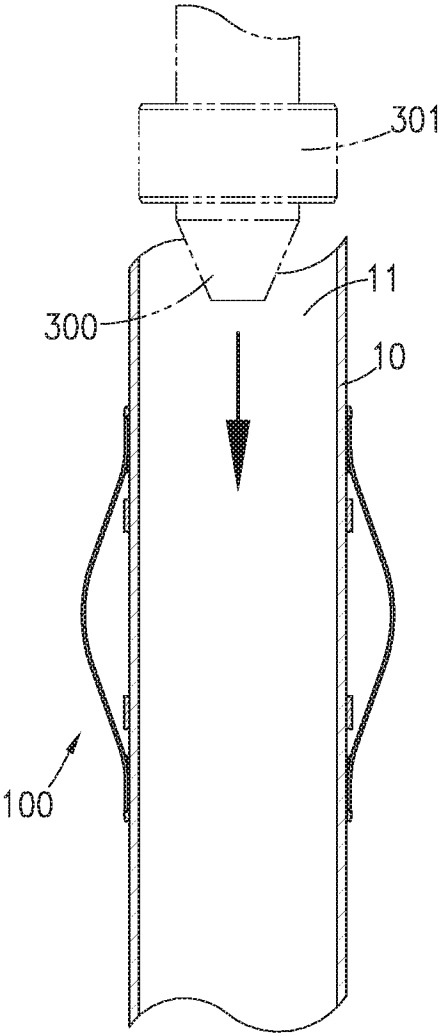

FIGS. 12 through 15 depict side sectional views of a sequential method for manufacturing a centralizer assembly of the present invention. Referring to FIG. 12, a bow spring assembly 100 is installed over the outer surface of casing section 10. Casing swage ram 300 having a desired head 301 is inserted into the central bore 11 of said casing section 10. Referring to FIG. 13, said casing swage head 301 is positioned within central bore 11 in general alignment with said bow spring assembly 100 (typically, between upper end band 101 and lower end band 103. Referring to FIG. 14, swage head 301 is engaged and expanded (typically using hydraulic fluid) to deform casing section 10 in order to create a desired upset—that is, an expanded section 20 of increased outer diameter—in casing section 10. Said expanded area 20 formed by said swaging operation can be beneficially positioned between upper end band 101 and lower end band 103, between upper bushing 30 and lower bushing 40, and under said plurality of bow springs 110. Referring to FIG. 15, swage head 301 is contracted, and swage ram 300 (including swage head 301) is retrieved from central bore 11 of casing section 10 leaving expanded area 20 formed in said casing section 10.

Referring back to FIGS. 8 and 9, said swaging operation can be aligned with a previously-applied expanded bushing 60 installed on the outer surface of casing section 10. In this manner, formation of expanded area 20 by said swaging process, also causes said expanded bushing 60 to expand radially outward.

Figure 16:
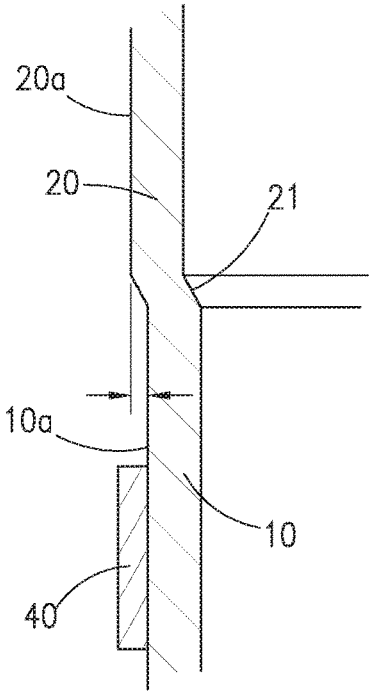
FIG. 16 depicts a detailed side view of a portion of a centralizer assembly of the present invention, as highlighted in area "16" of FIG. 4.

FIG. 16 depicts a side view of a portion of a centralizer assembly of the present invention, which is a detailed view of highlighted area "16" in FIG. 4. As depicted in FIG. 16, formation of expanded section 20 of increased outer diameter in casing section 10 (via swaging or other expansion process) results in outer surface 20*a* of said expanded section 20 being offset from outer surface 10*a* of casing section 10. The amount of said offset can depend on the severity of transition section 21 disposed between said expanded section 20 and un-swaged tube body of casing section 10.

Figure 17:
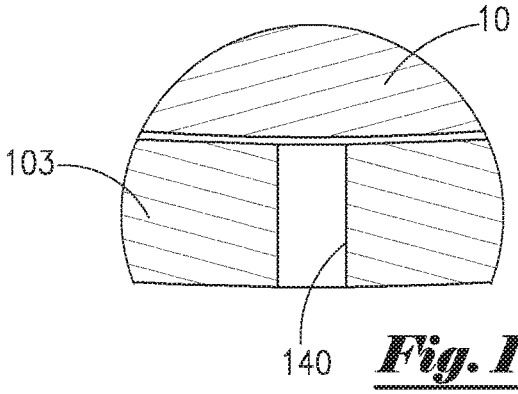
FIG. 17 depicts a sectional view of a lubrication port of a centralizer assembly of the present invention.

FIG. 17 depicts a sectional view of a lubrication port of a centralizer assembly of the present invention. Rotational interference between bow spring assembly 100 and casing section 10 can be reduced by employing friction reducing means to assist or improve rotation of said bow spring assembly 100 about said casing section 10. FIG. 17 depicts a sectional view of an injection port 140 extending through end band 103. Grease or other lubricant can be injected through said injection port 140 to lubricate contact surfaces between said centralizer end band 103 and casing section 10. Additionally, corrosion inhibiting materials can be included with such lubricant or injected separately in order to protect bow spring assembly 100 and casing section 10 from corroding or oxidizing, particularly during extended periods of non-use or storage.

Friction reducing means can include bearings (including, but not necessarily limited to, fluid bearings, roller bearings, ball bearings or needle bearings). Said bearings can be mounted on the outer surface of said central casing section, the inner surface of said centralizer end bands, or both. Referring back to FIG. 10, friction reducing bearing 150 is disposed between centralizer end band 103 and casing section 10 to decrease rotational interference between said end band 103 and casing section 10.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A well centralizer assembly disposed along an outer surface of a pipe section having a length comprising:

a) a first band member rotatably disposed around said outer surface of said pipe section;

b) a second band member rotatably disposed around the outer surface of said pipe section;

c) a plurality of bow spring members, each having a first end and a second end, wherein each of said first ends are connected to said first band member and each of said second ends are connected to said second band member; and wherein said pipe section has an area of expanded inner diameter and outer diameter positioned between said first and second band members configured to limit axial travel of said first band member and said second band member along the length of said pipe section.

2. The well centralizer assembly of claim 1, further comprising:

a) a first bushing ring extending at least partially around the outer surface of said pipe section and disposed between said area of expanded outer diameter and said first band member; and b) a second bushing ring extending at least partially around the outer surface of said pipe section and disposed between said area of expanded outer diameter and said second band member.

3. The well centralizer assembly of claim 1, further comprising a bushing ring extending at least partially around the outer surface of said pipe section at said area of expanded inner diameter and outer diameter.

4. The well centralizer assembly of claim 1, further comprising:

a) a first support member disposed between at least one bow spring member and said first band member; and b) a second support member disposed between at least one bow spring member and said second band member.

5. The well centralizer assembly of claim 1, wherein said bow spring members do not contact said expanded outer diameter of said pipe section when said bow spring members are fully elongated.

6. The well centralizer assembly of claim 1, further comprising at least one lubrication port extending through said first band member or said second band member.

7. The well centralizer assembly of claim 1, further comprising at least one bearing adapted for reducing friction between said pipe section, and said first band member or said second band member.

8. The well centralizer assembly of claim 1, wherein said first end of each bow spring member is flush mounted to said first band member and said second end of each bow spring member is flush mounted to said second band member, and no welds extend beyond the outer surfaces of said first or second band members.

9. The well centralizer assembly of claim 1, further comprising:

a) a recessed notch in said first band member, adapted to receive said first end of a bow spring member, wherein said recessed notch has at least one chamfered edge and said first end of said bow spring member is welded to said first band member; and b) a recessed notch in said second band member, adapted to receive said second end of a bow spring member, wherein said recessed notch has at least one chamfered edge and said second end of said bow spring member is welded to said second band member.

10. The well centralizer assembly of claim 1, wherein said well centralizer assembly at least partially comprises a non-abrasive or friction reducing material.

11. The well centralizer assembly of claim 1, wherein said bow spring members comprise a non-metallic material.

12. The well centralizer assembly of claim 1, wherein said bow spring members comprise a metallic body coated with a non-abrasive material.

13. The well centralizer assembly of claim 12, wherein said non-abrasive material comprises elastomeric polyurethane or polytetrafluoroethylene.

14. The well centralizer assembly of claim 1, wherein said pipe section comprises a single joint of casing, and said single joint of casing is installed within a casing string.

15. The well centralizer assembly of claim 1, wherein said pipe section comprises a single joint of drill pipe, and said single joint of drill pipe is installed within a drill string.

16. A method for manufacturing a wellbore centralizer comprising:

a) installing a centralizer assembly over an outer surface of a pipe section having a length, said centralizer assembly comprising:

i) a first band member having an inner diameter, wherein said first band member is rotatably disposed around the outer surface of said pipe section;

ii) a second band member having an inner diameter, wherein said second band member is rotatably disposed around the outer surface of said pipe section;

iii) a plurality of bow spring members, each having a first end and a second end, wherein said first end is connected to said first band member and said second end is connected to said second band member; and b) expanding the inner diameter and outer diameter of a portion of said pipe section between said first and said second band members until said outer diameter of said pipe section is at least as large as the larger of the inner diameters of said first band member and said second band member, wherein said portion of expanded inner diameter and outer diameter is configured to limit axial travel of said first band member and said second band member along the length of said pipe section.

17. The method of claim 16, wherein said step of expanding the inner diameter and outer diameter of said pipe section further comprises:

a) inserting a swage ram having a swage head into said pipe section;

b) positioning said swage head between said first end band and second end band members;

c) expanding said swage head to apply radially outward force against said pipe section; and d) deforming walls of said pipe section.

18. The method of claim 17, further comprising:

a) contracting said swage head; and b) removing said swage head from said pipe section.

19. The method of claim 16, wherein said pipe section comprises a single joint of casing, and said single joint of casing is installed within a casing string.

20. The method of claim 16, wherein said pipe section comprises a single joint of drill pipe, and said single joint of drill pipe is installed within a drill string.

* * * * *